US005386993A

United States Patent [19]

Apsan

[11] Patent Number: 5,386,993

[45] Date of Patent: Feb. 7, 1995

[54] ROTATABLE PUZZLE WITH OCTAHEDRAL BASE AND CONNECTED TETRAHEDRAL MEMBERS

[76] Inventor: Bernardo H. Apsan, Rua Caconde 546, Apt. 182, Cep 01425 Sao Paulo-SP, Brazil

[21] Appl. No.: 247,594

[22] Filed: May 23, 1994

[51] Int. Cl.[6] ..... A63F 9/08

[52] U.S. Cl. ..... 273/153 S

[58] Field of Search ..... 273/153 R, 156, 157 R, 273/153 S; 434/211

[56] References Cited

U.S. PATENT DOCUMENTS

| | | | |
|---|---|---|---|
| 3,659,360 | 5/1972 | Zeischegg | 273/157 R |
| 4,496,155 | 1/1985 | Goldfarb | 273/153 S |
| 4,593,908 | 6/1986 | Ibrahim | 273/153 S |
| 4,600,199 | 7/1986 | Krell | 273/153 |
| 4,706,956 | 11/1987 | Abu-Shumays et al. | 273/153 S |
| 4,836,549 | 6/1989 | Flake | 273/153 S |
| 5,108,100 | 4/1992 | Essebaggers et al. | 273/153 R |
| 5,199,711 | 4/1993 | Pataki et al. | 273/153 S |

OTHER PUBLICATIONS

"Games", Starburst puzzle photo, Jul./Aug. 1982, p. 55.

*Primary Examiner*—V. Millin
*Assistant Examiner*—William M. Pierce
*Attorney, Agent, or Firm*—David L. Baker

[57] ABSTRACT

This invention provides a three-dimensional puzzle, rotatable about three orthogonal axes, the three orthogonal axes consisting of a vertical axis, a first horizontal axis, and a second horizontal axis, the three-dimensional puzzle comprising: a hollow spherical base member having a first hemispherical base member, a second hemispherical base member, and a pivotable connection mechanism for connecting the first hemispherical base member to the second hemispherical base member and for allowing the first hemispherical base member and the second hemispherical base member to rotate in a plane defined by the first horizontal axis and the second horizontal axis; a track mechanism formed by an outer surface of the spherical base member; a plurality of sliding truncated trapezoidal covers slidably mounted in the track mechanism, each of the trapezoidal covers having a radially outward surface which forms one of the eight faces of the octahedral base member; and, a plurality of tetrahedral members, one tetrahedral member pivotally mounted on the radially outward surface of each of the sliding truncated trapezoidal covers.

11 Claims, 6 Drawing Sheets

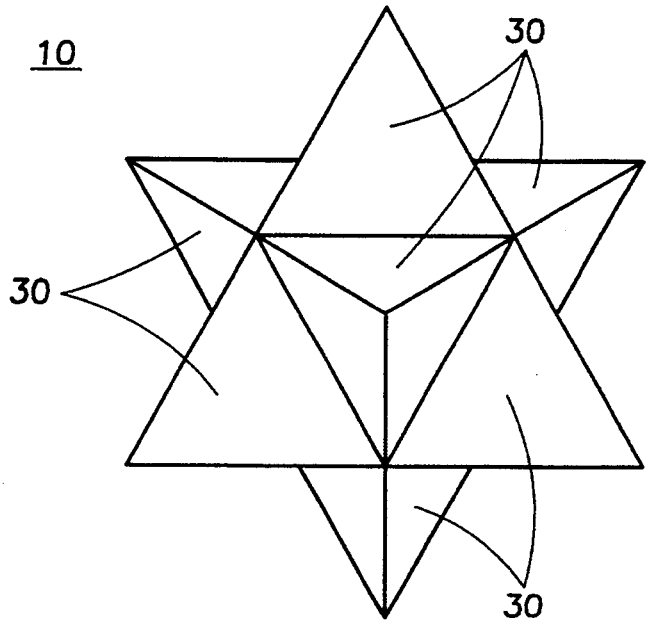
FIG. 1
FIG. 2
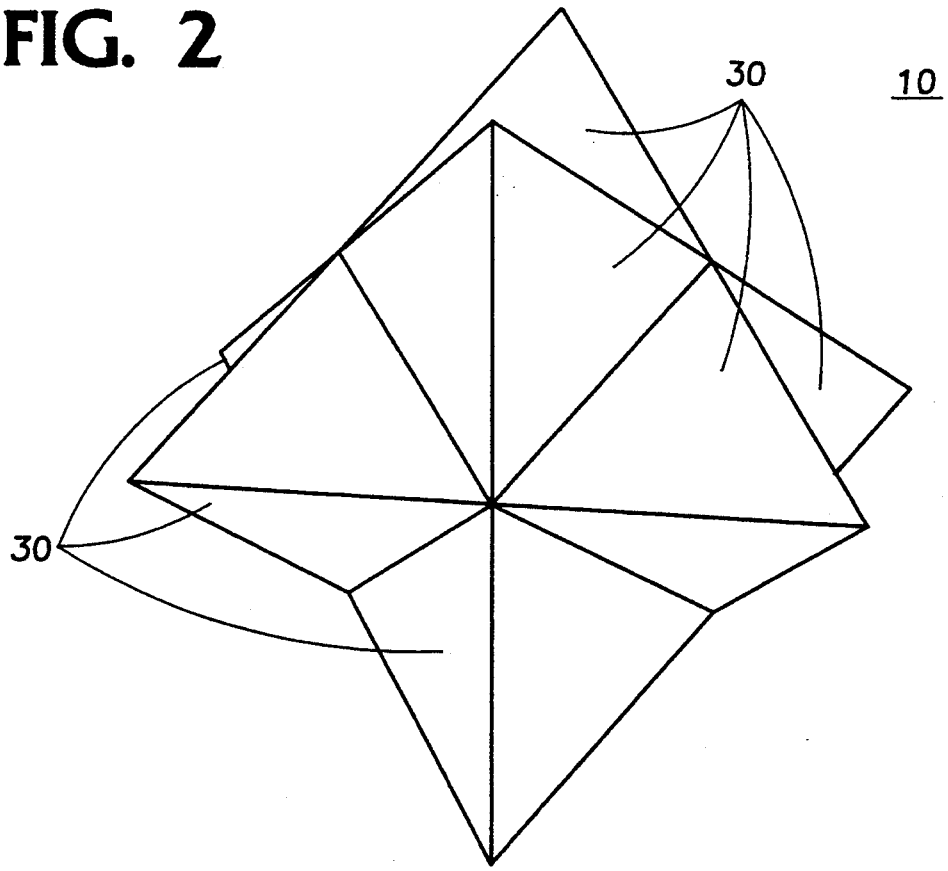

FIG. 3
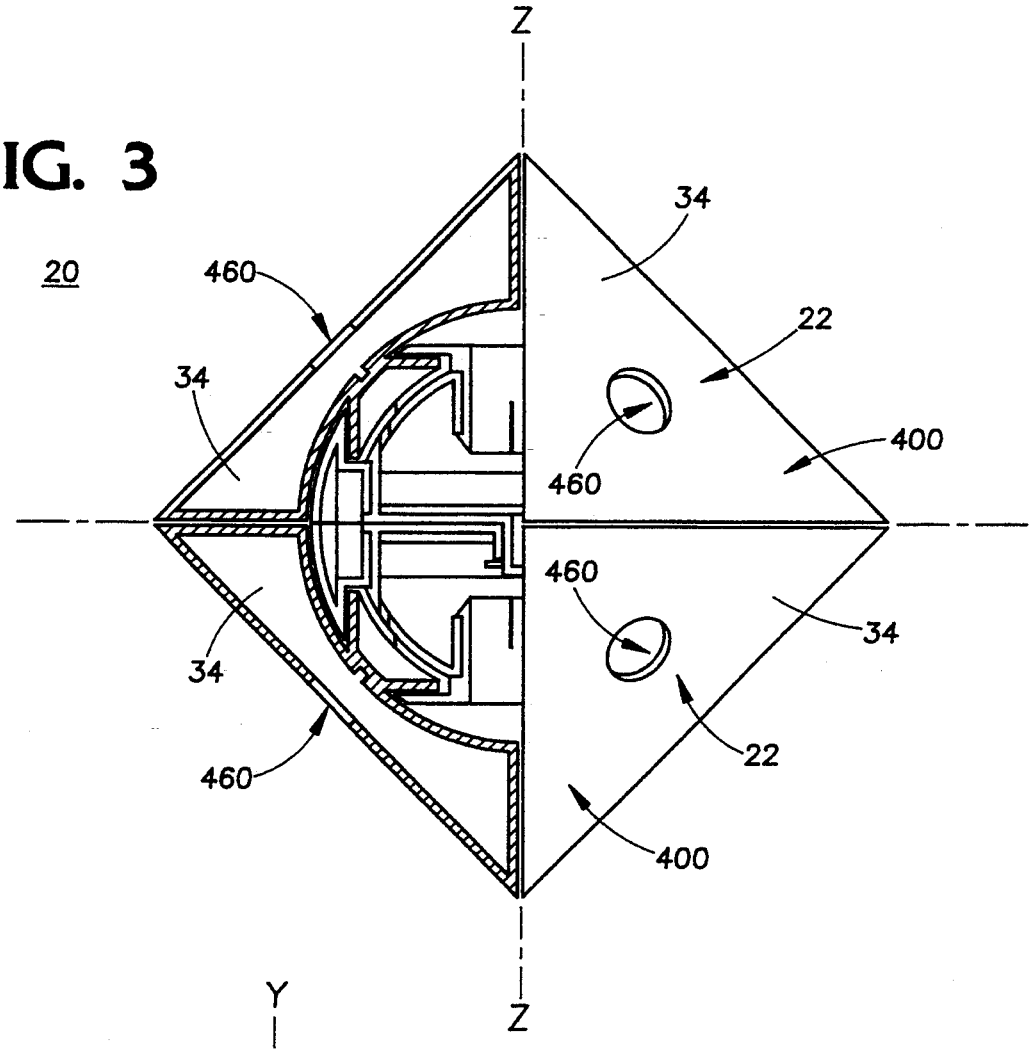
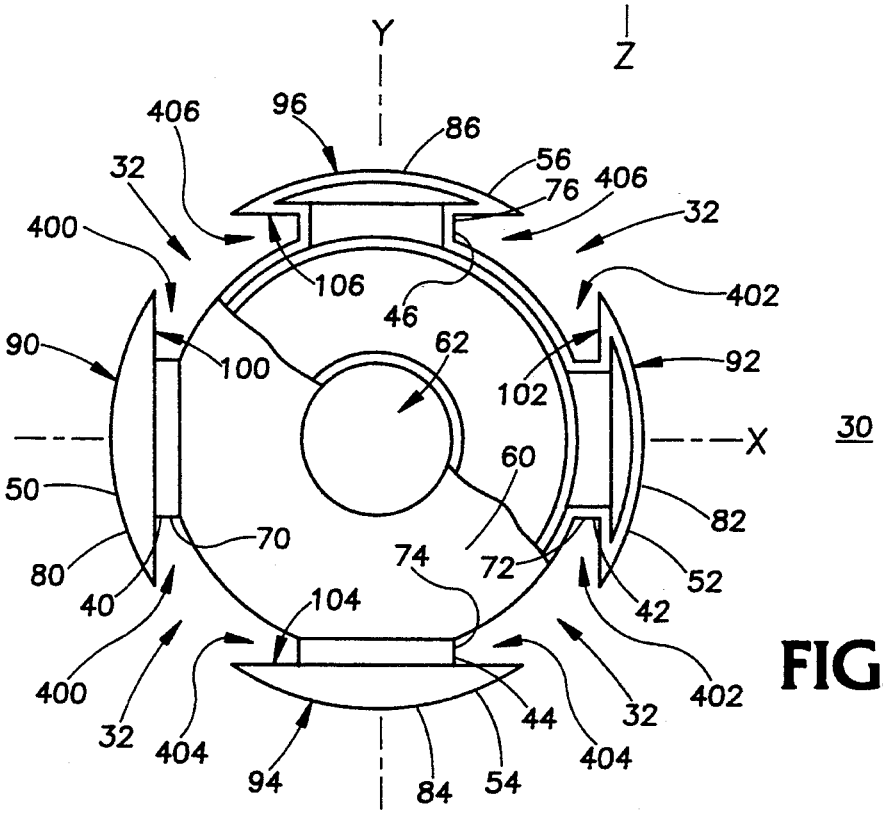
FIG. 4

FIG. 13
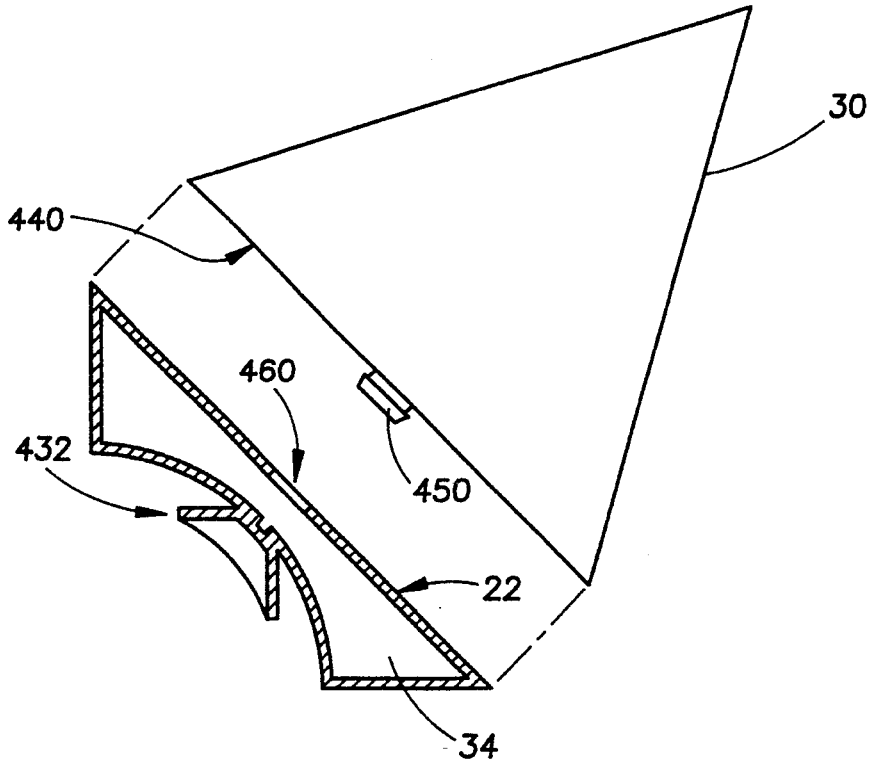
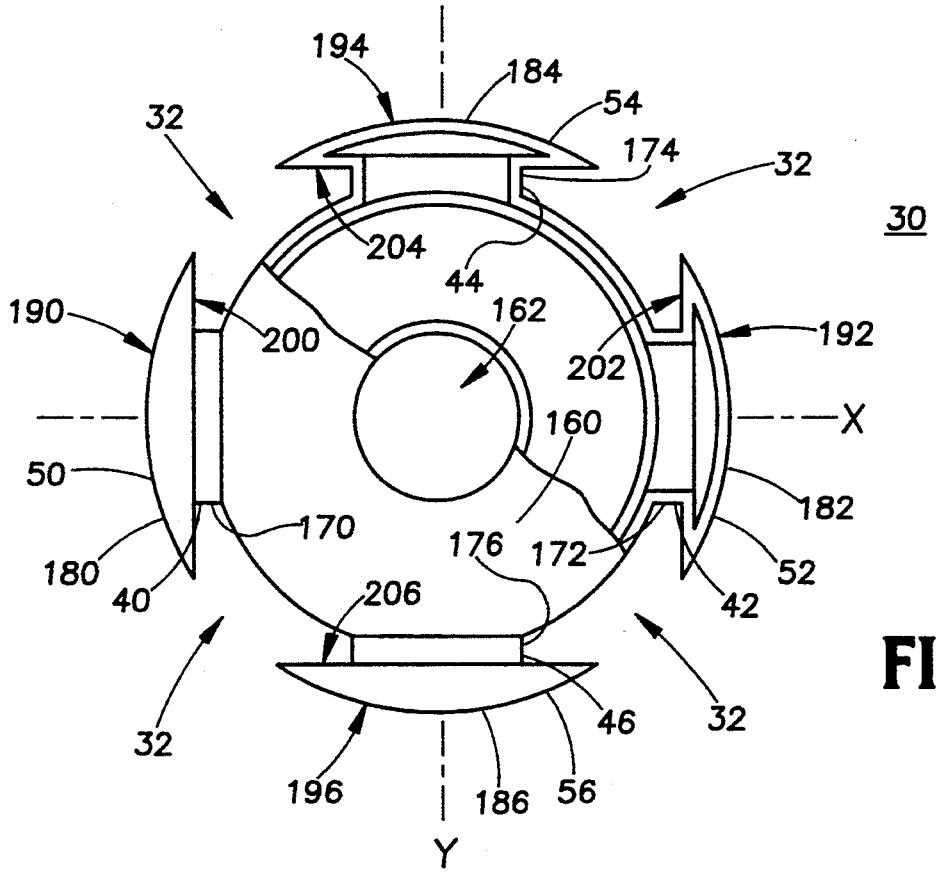
FIG. 6

FIG. 10
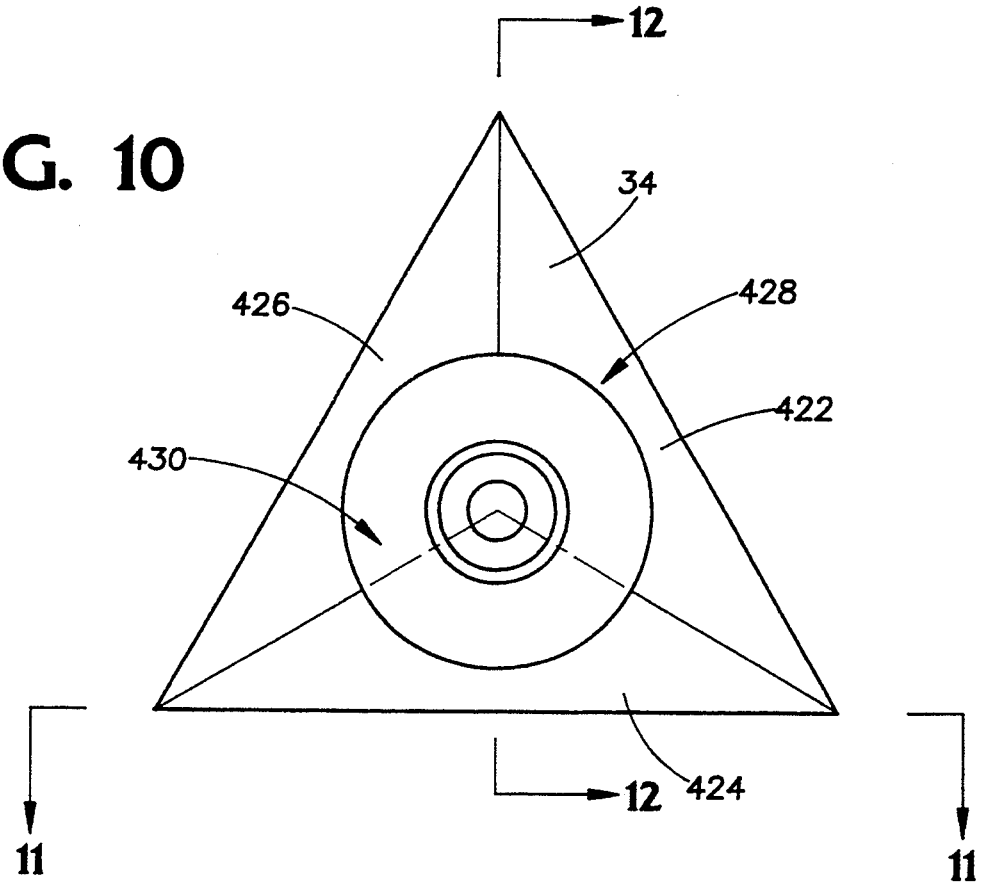
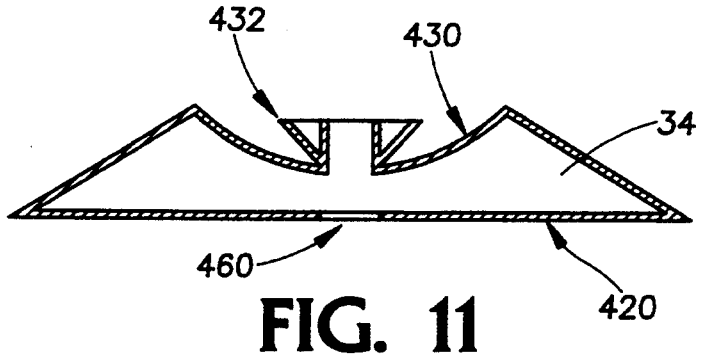
FIG. 11
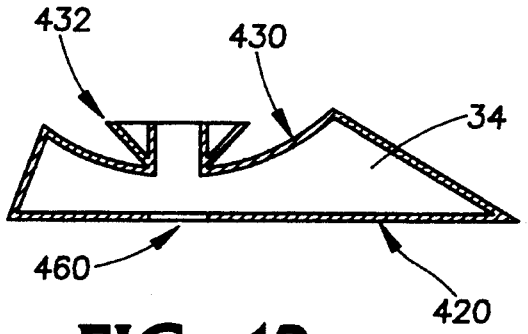
FIG. 12

ROTATABLE PUZZLE WITH OCTAHEDRAL BASE AND CONNECTED TETRAHEDRAL MEMBERS

FIELD OF THE INVENTION

1. Field of the Invention.

This invention relates to three-dimensional puzzles having parts which can be rotated about orthogonal axes. More particularly, the invention relates to multi-sided segmented devices which can be manipulated by hand for rotating a portion of the device to various positions relative to other portions of the device.

2. Background Art

This invention relates to a three-dimensional puzzle which is based upon a regular octahedron having tetrahedrons rotatably mounted on each octahedral face. Puzzles of this nature are useful not only as toys but as educational devices as well, aiding in the development of spatial reasoning, imagination, and memory capacity. The puzzles could additionally serve as decorative pieces.

One of the most famous three dimensional puzzles of similar type is the puzzle sold by Ideal Toy Corporation under the trademark "Rubik's Cube" which was disclosed in Hungarian Patent Number 170062.

U.S. Pat. No. 4,600,199 issued to Krell on Jul. 15, 1986 discloses a three dimensional puzzle having pieces formed in layers which can slidably move about the surface of an inner fastening means. The puzzle has an outer configuration of a crystal or a cube which is subdivided into slices or layers which can be rotated individually or jointly around a central point of rotation located in the center of the puzzle.

U.S. Pat. No. 4,706,956 issued to Abu-Shumays et al. on Nov. 17, 1987 relates regular polyhedron puzzles which include octahedron and icosahedron cubic puzzles.

U.S. Pat. No. 4,836,549 issued to Flake on Jun. 6, 1989 shows a multi-faceted puzzle toy having eight heptahedrons anchored to a central sphere, with four of the heptahedrons each attached directly to the central sphere with internal axles, and the other four heptahedrons mounted on axles which are anchored to a convex base plate movable around the central sphere by means of an internal tongue and groove system.

U.S. Pat. No. 5,108,100 issued to Essebaggers et al. on Apr. 28, 1992 discloses a pyramid puzzle formed from tetrahedral and octahedral pieces connected by a strand.

U.S. Pat. No. 5, 199,711 issued to Pataki et al. provides a three-dimensional logical toy having regular, irregular, or amorphous composite members of various shapes. The composite enclosing body is made up of eighteen shaped members falling into three different groups and arranged in three mutually parallel layers which are delimited by two surfaces, one having the configuration of a regular hexagram and parallel thereto having the configuration of a regular hexagonal.

None of the above inventions provides for a regular octahedron having tetrahedrons rotatably mounted on each octahedral face.

SUMMARY OF THE INVENTION

It is an object of this invention to provide a three-dimensional puzzle having parts which can be rotated about orthogonal axes.

It is a further object of this invention to provide a multi-sided segmented device which can be manipulated by hand for rotating a portion of the device to various positions relative to other portions of the device.

It is a still further object of this invention to provide a three-dimensional puzzle which is based upon a regular octahedron having tetrahedrons rotatably mounted on each octahedral face.

It is another object of this invention to provide external surfaces which can be allocated a predetermined combination of colors or pictures, and to provide a means to rearrange that combination and subsequently restore the various surfaces into their original configuration or into in alternate interesting designs.

It is yet another object to provide for the arrangement and rearrangement of the components which make up the puzzle along predetermined axes of the coordinates by means of rotation, such that the various possible relative rotations result in mixing up the visual surface configurations formed by the outer surfaces of the components.

It is another object of this invention to provide a three-dimensional puzzle having multiple projecting tetrahedral members that can be manipulated relative to a central octahedral supporting member and having the tetrahedral members also being individually manipulable to change their orientation about a pivot axis atop the octahedral supporting member.

The above objects and other advantages and objects are achieved by the present invention by preferably providing a three-dimensional puzzle, rotatable about three orthogonal axes, the three orthogonal axes consisting of a vertical axis, a first horizontal axis, and a second horizontal axis, the three-dimensional puzzle is an octahedral base member having eight outer surfaces and eight tetrahedral members, one tetrahedral member pivotally mounted on each of the eight outer surfaces.

Preferably, the three-dimensional puzzle comprises a hollow spherical base member, a track means formed by an outer surface of the spherical base member, a plurality of sliding truncated trapezoidal covers slidably mounted in the track means, and a plurality of tetrahedral members pivotally mounted to the radially outward facing surfaces of the trapezoidal covers. The radially outward facing surfaces of the trapezoidal covers form the eight faces of the octahedral base member.

The hollow spherical base member is preferably constructed of a first hemispherical base member, a second hemispherical base member, and a pivotable connection means for connecting the first hemispherical base member to the second hemispherical base member. The first hemispherical base member and the second hemispherical base member thus are able to rotate with respect to each other.

The hollow spherical base member further comprises outwardly extending cylindrical supports having spherical-segment portions at the outermost portion of each cylindrical support.

A first pair of diametrically opposed cylindrical supports is fixedly attached to an outer surface of the hollow spherical base member and extends radially outward therefrom along the first horizontal axis. A first pair of diametrically opposed spherical-segment portions is also provided, one of the first pair of spherical-segment portions being positioned on a radially outwardmost surface of one of the first pair of diametrically opposed cylindrical supports, and the other of the first pair of spherical-segment portions being positioned on a radially outwardmost surface of the other one of the first pair of diametrically opposed cylindrical supports. The first pair of diametrically opposed spherical-segment portions is also concentric with the first horizontal axis.

A second pair of diametrically opposed cylindrical supports fixedly attached to an outer surface of the hollow spherical base member and extending radially outward therefrom along the second horizontal axis. A second pair of diametrically opposed spherical-segment portions is also provided, one of the second pair of spherical-segment portions being positioned on a radially outwardmost surface of one of the second pair of diametrically opposed cylindrical supports, and the other of the second pair of spherical-segment portions being positioned on the other one of the second pair of diametrically opposed cylindrical supports. The second pair of diametrically opposed spherical-segment portions is also concentric with the second horizontal axis.

The track means comprises at least one channel formed from an exterior surface of each of the first hemispherical base member, the second hemispherical base member, the first pair of diametrically opposed cylindrical supports, the second pair of diametrically opposed cylindrical supports, the first pair of diametrically opposed spherical-segment portions, and the second pair of diametrically opposed spherical-segment portions.

The first hollow hemispherical base member comprises a hollow hemispherical inverted bowl member; a cap-receiving channel disposed at the top of the hollow hemispherical inverted bowl member and being concentric with the vertical axis; a cap for locking insertion into the cap receiving channel; a first pair of diametrically opposed demi-cylindrical supports fixedly attached to an exterior surface of the hollow hemispherical inverted bowl member and extending radially outward therefrom; a first pair of diametrically opposed spherical-segment demi-portions, each of the demi-portions being fixedly attached to an outwardmost radially extending surface of one of the first pair of diametrically opposed demi-cylindrical supports; a second pair of diametrically opposed demi-cylindrical supports fixedly attached to the exterior surface of the hollow hemispherical inverted bowl member and extending radially outward therefrom; and a second pair of diametrically opposed spherical-segment demi-portions, each of the demi-portions being fixedly attached to an outwardmost radially extending surface of one of the second pair of diametrically opposed demi-cylindrical supports.

Similarly, the second hollow hemispherical base member comprises a hollow hemispherical bowl member; a cap-receiving channel disposed at a bottom of the hollow hemispherical bowl member and being concentric with the vertical axis; a cap for locking insertion into the cap-receiving channel; a first pair of diametrically opposed demi-cylindrical supports fixedly attached to an exterior surface of the hollow hemispherical bowl member and extending radially outward therefrom; a first pair of diametrically opposed spherical-segment demi-portions, each of the demi-portions being fixedly attached to an outwardmost radially extending surface of one of the first pair of diametrically opposed demi-cylindrical supports; a second pair of diametrically opposed demi-cylindrical supports fixedly attached to the exterior surface of the hollow hemispherical bowl member and extending radially outward therefrom; and a second pair of diametrically opposed spherical-segment demi-portions, each of the demi-portions being fixedly attached to an outwardmost radially extending surface of one of the second pair of diametrically opposed demi-cylindrical supports.

Thus, the first hollow hemispherical base member and the second hollow hemispherical base member are connected together so as to form the hollow spherical base member. The first pair of diametrically opposed spherical-segment demi-portions of the first hollow hemispherical base member and the first pair of diametrically opposed spherical-segment demi-portions of the second hollow hemispherical base member mate to form the first pair of diametrically opposed spherical-segment portions. The second pair of diametrically opposed spherical-segment demi-portions of the first hollow hemispherical base member and the second pair of diametrically opposed spherical-segment demi-portions of the second hollow hemispherical base member mate to form the second pair of diametrically opposed spherical-segment portions. The first pair of diametrically opposed demi-cylindrical supports of the first hollow hemispherical base member and the first pair of diametrically opposed demi-cylindrical supports of the second hollow hemispherical base member mate to form the first pair of diametrically opposed cylindrical supports. And, the second pair of diametrically opposed demi-cylindrical supports of the first hollow hemispherical base member and the second pair of diametrically opposed demi-cylindrical supports of the second hollow hemispherical base member mate to form the second pair of diametrically opposed cylindrical supports.

The first hollow hemispherical base member further comprises two pairs of diametrically opposed locking recesses provided on an interior surface of the hollow hemispherical inverted bowl member. Similarly, the second hollow hemispherical base member further comprises two pairs of diametrically opposed locking recesses provided on an interior surface of the hollow hemispherical bowl member.

The pivotable connection means comprises a first pivoting lock support, a second pivoting lock support, and a washer.

The first pivoting lock support comprises a first circular disc-shaped base; a protruding cylindrical male hemisphere connection member extending downward from a center of a bottom surface of the first circular disc-shaped base; two pairs of diametrically opposed upper locking struts; and locking teeth disposed at an upper tip of each of the upper locking struts.

The second pivoting lock support comprises a second circular disc-shaped base; a cylindrical female hemispherical connection cavity extending downward from a center of a bottom surface of the second circular disc-shaped base, the cavity for receiving the protruding cylindrical male hemisphere connection member; two pairs of diametrically opposed lower locking struts fixedly attached to a lower surface of the second circular disc-shaped base; and locking teeth disposed at a lower tip of each of the lower locking struts.

The washer has an inner diameter substantially equal to an outer diameter of the protruding cylindrical male hemisphere connection member, whereby the washer fits over the protruding cylindrical male hemisphere connection member and remains locked in place by pressure-fit. The protruding cylindrical male hemisphere connection member rotatably is then able to pivot within the cylindrical female hemisphere connection cavity, thereby providing a pivot for the relative rotation between the first hemispherical base member and the second hemispherical member around the vertical axis.

Each cap comprises a substantially quadrangular head section and a hollow central cylindrical tail section. The tail section has two pairs of diametrically opposed locking tabs disposed at the bottom of the cap.

The channel of the track means preferably comprises two pairs of substantially circular channels. A first pair of substantially circular channels is concentric with the first horizontal axis and is formed by the exterior surfaces of the hollow hemispherical inverted bowl member, the hemispherical bowl member, the cap lockably inserted into the inverted bowl member, the cap lockably inserted into the hemispherical bowl member, the first pair of diametrically opposed cylindrical supports and the first pair of diametrically opposed spherical-segment portions. A second pair of substantially circular channels is concentric with the second horizontal axis and is formed by the exterior surfaces of the hollow hemispherical inverted bowl member, the hemispherical bowl member, the cap lockably inserted into the inverted bowl member, the cap lockably inserted into the hemispherical bowl member, the second pair of diametrically opposed cylindrical supports and the second pair of diametrically opposed spherical-segment portions.

Preferably eight sliding truncated trapezoidal covers are provided each having a triangular lower base having a flat surface; three inwardly inclined vertical walls; and a substantially circular upper base. The substantially circular upper base has an upwardly concave surface and a guide disposed in a center of the upwardly concave surface and upwardly extending therefrom. The guide has an inverted truncated conical outer wall, and the guide fits into the channel of the track means for providing the sliding engagement of the guide within the channel, thus providing for the sliding engagement of the sliding truncated trapezoidal covers over the surface of the hollow spherical base member. The triangular lower base faces radially outwardly from the hollow spherical base member.

Eight tetrahedrons are provided, each tetrahedron having a triangular base with a periphery substantially similar to the triangular lower base of the truncated trapezoidal covers, and having a tetrahedral connection means disposed on an outer surface of the triangular base for connecting the tetrahedron to the triangular lower base of one of the truncated trapezoidal covers.

The tetrahedrons can be removed from the facets of the octohedron and be attached to the desired facets and the present invention will still be an amusing toy. This feature can be the "solution" for those who cannot arrive at the solution in the "normal" manner.

A further understanding of the invention will be obtained by consideration of the figures and the description which follows.

BRIEF DESCRIPTION OF THE DRAWINGS

FIG. 1 is a perspective view of the present invention showing seven out of eight tetrahedral members mounted atop an octahedral base.

FIG. 2 is another perspective view of the present invention.

FIG. 3 is a perspective drawing of the assembled octahedral base, shown in partial cross-section to reveal the hollow spherical base member and the sliding truncated trapezoidal covers.

FIG. 4 is a top view of the hollow spherical base member.

FIG. 6 is a bottom view of the hollow spherical base member.

FIG. 10 is top view of a sliding truncated trapezoidal cover.

FIG. 11 is cross-sectional view of a sliding truncated trapezoidal cover along line 11—11 of FIG. 10.

FIG. 12 is cross-sectional view of a sliding truncated trapezoidal cover along line 12—12 of FIG. 10.

FIG. 13 is a side elevational view of a tetrahedral member, showing a preferred connection means to a sliding truncated trapezoidal cover, the cover shown in a cross-section cut through the center of the cover to show the connection means.

DETAILED DESCRIPTION OF THE PREFERRED EMBODIMENT

Figure 5:
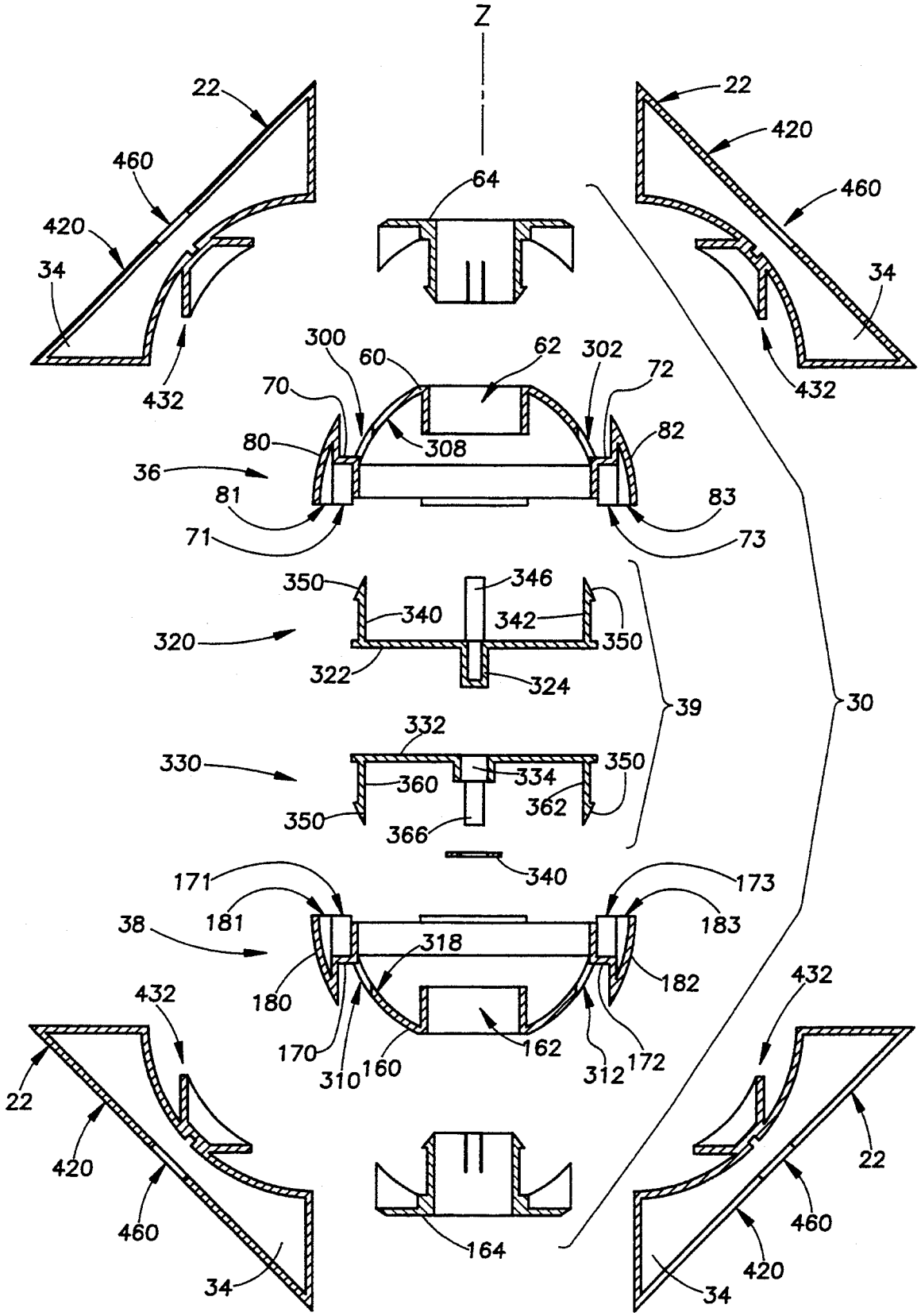
FIG. 5 is an exploded view of the present invention without the tetrahedral members, the elements being shown in cross-section.

The preferred embodiment of the present invention is a three-dimensional puzzle 10 (see FIGS. 1 and 2) based upon a regular octahedral base member 20 (see FIG. 3) having a tetrahedron 30 disposed upon each of the eight outer faces 22 of the octahedron 20.

For convenience, it is useful to consider three orthogonal (rectangular) axes about which portions of the puzzle 10 rotate: a vertical axis, a first horizontal axis, and a second horizontal axis. For example, if a sheet of paper is placed upon a horizontal surface, two orthogonal axes could be drawn upon the paper: a first horizontal axis (e.g. an X-axis) and a second horizontal axis (e.g. a Y-axis). A third orthogonal axis (e.g. a Z-axis) could then extend vertically through the X-Y plane of the paper.

The octahedral base member 20 is comprised of a hollow spherical base member 30 (FIG. 4), a track means 32 on the outer surface of the hollow spherical base member 30, and a plurality of sliding truncated trapezoidal covers 34 slidingly mounted in the track means 32 (see FIGS. 5 and 6).

As best seen in FIG. 5, the hollow spherical base member 30 comprises a first hemispherical base member 36 and a second hemispherical base member 38 which are interconnected by a pivotable connection means 39. The pivotable connection means 39 allows the first and second hemispherical base members, 36 and 38 respectively, to rotate about a vertical axis Z, in a plane defined by the first horizontal axis X and the second horizontal axis Y.

As seen in FIG. 4, the hollow spherical base member 30 further comprises four cylindrical supports (40, 42, 44, and 46) fixedly attached to or integrally formed with the outer surface of the hollow spherical base member 30. A first pair of diametrically opposed cylindrical supports (40 and 42) extend radially outwardly from the outer surface of the hollow spherical base member 30 along the first horizontal axis X. A second pair of diametrically opposed cylindrical supports (44 and 46) extend radially outwardly from the outer surface of the hollow spherical base member 30 along the second horizontal axis Y. It is to be understood that the cylindrical supports (40, 42, 44, 46) may be made integrally with the hollow spherical base member 30, or may be separately formed and thereafter fixedly attached thereto.

As best seen in FIG. 4, the hollow spherical base member 30 still further comprises four spherical-segment portions (50, 52, 54, 56) fixedly attached to or integrally formed with the cylindrical supports (40, 42, 44, and 46, respectively). Each spherical-segment portion has the shape of a segment of a sphere. Each spherical-segment portion (50, 52, 54, or 56) is positioned on the radially outwardmost surface of its corresponding cylindrical support (40, 42, 44, 46, respectively). A first pair of diametrically opposed spherical-segment portions (50 and 52) are mounted on the first pair of cylindrical supports (40 and 42, respectively), the spherical-segment portions 50 and 52 being concentric with the first horizontal axis X. Similarly, a second pair of diametrically opposed spherical-segment portions (54 and 56) are mounted on the second pair of cylindrical supports (44 and 46, respectively), the spherical-segment portions 54 and 56 being concentric with the second horizontal axis Y. It is to be understood that the spherical-segment portions (50, 52, 54, 56) may be made integrally with the cylindrical supports (40, 42, 44, 46), or may be separately formed and thereafter fixedly attached thereto.

Preferably, the cylindrical supports (40, 42, 44, 46) and the spherical-segment portions (50, 52, 54, 56) are formed from two mating halves substantially symmetric about the X-Y plane.

Thus, as best seen in FIG. 4, the first hollow hemispherical base member 36 comprises: a hollow hemispherical inverted bowl member 60; a cap-receiving channel 62 being disposed at the top of the inverted bowl member 60 and being concentric with the vertical axis Z; a cap 64 for locking insertion into the cap-receiving channel 62; a first pair of diametrically opposed demi-cylindrical supports (70 and 72, respectively) extending radially outwardly from the inverted bowl member 60 and having a substantially flat lower surface with a longitudinal axis coincident with the first horizontal axis X; a second pair of diametrically opposed demi-cylindrical supports (74 and 76, respectively) extending radially outwardly from the inverted bowl member 60 and having a substantially flat lower surface (71 and 73, respectively, in FIG. 5) with a longitudinal axis coincident with the second horizontal axis Y; a first pair of diametrically opposed spherical-segment demi-portions (80 and 82) extending radially outward from the corresponding demi-cylindrical support (70 or 72, respectively) and having a substantially flat lower surface with a longitudinal axis coincident with the first horizontal axis X; and a second pair of diametrically opposed spherical-segment demi-portions (84 and 86) extending radially outward from the corresponding demi-cylindrical support (74 or 76, respectively) and having a substantially flat lower surface with a longitudinal axis coincident with the second horizontal axis Y.

As seen in FIG. 5, each one of the first pair of diametrically opposed spherical-segment demi-portions (80 and 82) has a flat bottom surface (81 and 83, respectively), an outwardly radial surface with the contour of a spherical segment (90 and 92, respectively), and a flat inner surface (100 and 102, respectively) which is fixedly attached to the outwardmost radially extending surface of one of the corresponding first pair of demi-cylindrical supports (70 or 72, respectively). As seen in FIGS. 4 and 5, the flat inner surface (100 or 102) has a larger diameter than the outer diameter of the demi-cylindrical support (70 or 72, respectively). Similarly, each one of the second pair of diametrically opposed spherical-segment demi-portions (84 and 86) has a flat bottom surface, an outwardly radial surface with the contour of a spherical segment, and a flat inner surface which is fixedly attached to the outwardmost radially extending surface of one of the corresponding second pair of demi-cylindrical supports (74 and 76, respectively). The flat inner surface of each spherical-segment demi-portion (80, 82, 84, or 86) has a larger diameter than the outer diameter of its corresponding demi-cylindrical support (70, 72, 74, or 76, respectively).

Similarly, as seen in FIGS. 5 and 6, the second hollow hemispherical base member 38 comprises: a hollow hemispherical bowl member 160; a cap-receiving channel 162 being disposed at the bottom of the bowl member 160 and being concentric with the vertical axis Z; a cap 164 for locking insertion into the cap-receiving channel 162; a first pair of diametrically opposed demi-cylindrical supports (170 and 172, respectively) extending radially outwardly from the bowl member 160 and having substantially flat upper surface (171 and 173, respectively) with a longitudinal axis coincident with the first horizontal axis X; a second pair of diametrically opposed demi-cylindrical supports (174 and 176, respectively) extending radially outwardly from the bowl member 160 and having a substantially flat upper surface with a longitudinal axis coincident with the second horizontal axis Y; a first pair of diametrically opposed spherical-segment demi-portions (180 and 182) extending radially outward from the corresponding demi-cylindrical support (170 or 172, respectively) and having a substantially flat upper surface with a longitudinal axis coincident with the first horizontal axis X; and a second pair of diametrically opposed spherical-segment demi-portions (184 and 186) extending radially outward from the corresponding demi-cylindrical support (174 or 176, respectively) and having a substantially flat lower surface with a longitudinal axis coincident with the second horizontal axis Y.

As seen in FIGS. 5 and 6, each one of the first pair of diametrically opposed spherical-segment demi-portions (180 and 182) has a flat upper surface (181 and 183, respectively), an outwardly radial surface with the contour of a spherical segment (190 and 192, respectively), and a flat inner surface (200 and 202, respectively) which is fixedly attached to the outwardmost radially extending surface of one of the corresponding first pair of demi-cylindrical supports (170 or 172, respectively). The flat inner surface (200 or 202) has a larger diameter than the outer diameter of the demi-cylindrical support (170 or 172, respectively). Similarly, each one of the second pair of diametrically opposed spherical-segment demi-portions (184 and 186) has a flat upper surface, an outwardly radial surface with the contour of a spherical segment, and a flat inner surface which is fixedly attached to the outwardmost radially extending surface of one of the corresponding second pair of demi-cylindrical supports (174 and 176, respectively). The flat inner surface of each spherical-segment demi-portion (180, 182, 184, or 186) has a larger diameter than the outer diameter of its corresponding demi-cylindrical support (170, 172, 174 or 176, respectively).

As shown in FIGS. 4–6, demi-cylindrical supports ( 70, 72, 74, 76, 170, 172, 174, and 176) and spherical-segment demi-portions (80, 82, 84, 86, 180, 182, 184, and 186) are preferably hollow. The flat inner surface of each spherical-segment demi-portion preferably extends from the outer periphery of the spherical segment demi-portion to the outer periphery of the demi-cylindrical portion sufficiently to enable a secure connection between each portion, whether the portions are integrally formed together or separately formed and fixedly attached thereto.

It can be seen from FIGS. 3–6 that when the first and second hollow hemispherical base members, 36 and 38, respectively, are connected together the two pieces mate to form the hollow spherical base member 30.

The first and second hollow hemispherical base members, 36 and 38, respectively, being so connected, the first pair of diametrically opposed spherical-segment demi-portions (80 and 82), of the first hollow hemispherical base member 36 and the first pair of diametrically opposed spherical-segment demi-portions (180 and 182) of the second hollow hemispherical base member 38 mate to form the first pair of diametrically opposed spherical-segment portions (50 and 52). The second pair of diametrically opposed spherical-segment demi-portions (84 and 86) of the first hollow hemispherical base member 36 and the second pair of diametrically opposed spherical-segment demi-portions (184 and 186) of the second hollow hemispherical base member 38 mate to form the second pair of diametrically opposed spherical-segment portions (54 and 56, respectively). The first pair of diametrically opposed demi-cylindrical supports (70 and 72) of the first hollow hemispherical base member 36 and the first pair of diametrically opposed demi-cylindrical supports (170 and 172) of the second hollow hemispherical base member 38 mate to form the first pair of diametrically opposed cylindrical supports (40 and 42). Finally, the second pair of diametrically opposed demi-cylindrical supports (74 and 76) of the first hollow hemispherical base member 36 and the second pair of diametrically opposed demi-cylindrical supports (174 and 176) of the second hollow hemispherical base member 38 mate to form the second pair of diametrically opposed cylindrical supports (44 and 46, respectively).

The first hollow hemispherical base member 36 further comprises a first pair of diametrically opposed locking recesses (300 and 302) provided on the interior surface 308 of the hollow hemispherical inverted bowl member 60 in a plane defined by the vertical axis Z and the first horizontal axis X and a second pair of diametrically opposed locking recesses (not shown), similar to the first pair, provided on the interior surface of the hollow hemispherical inverted bowl member 60 in a plane defined by the vertical axis Z and the second horizontal axis Y.

The second hollow hemispherical base member 38 further comprises a first pair of diametrically opposed locking recesses (310 and 312) provided on the interior surface 318 of the hollow hemispherical bowl member 160 in a plane defined by the vertical axis Z and the first horizontal axis X and a second pair of diametrically opposed locking recesses (not shown) similar to the first pair, provided on the interior surface 318 of the hollow hemispherical bowl member 160 in a plane defined by the vertical axis Z and the second horizontal axis Y.

Figure 7:
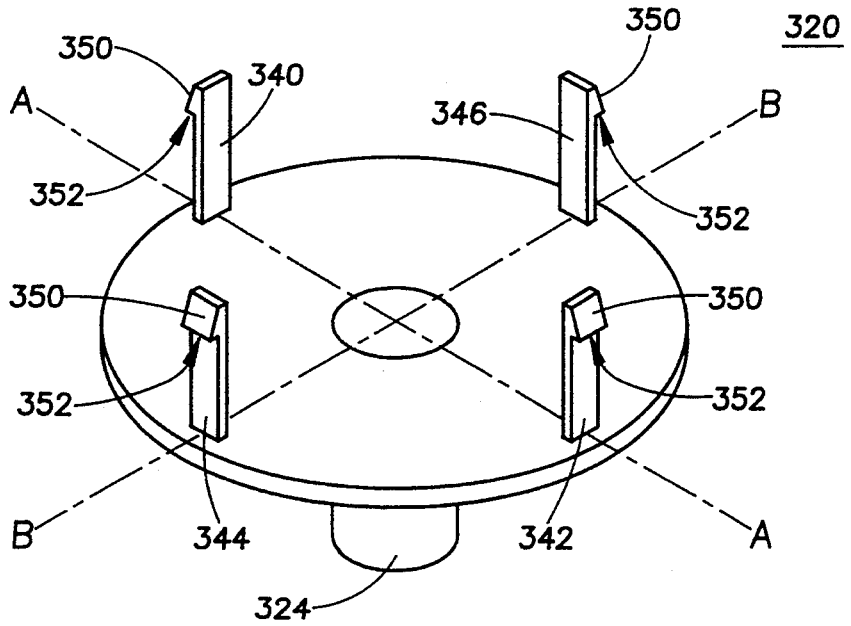
FIG. 7 is a perspective view of the first pivoting lock support.
Figure 8:
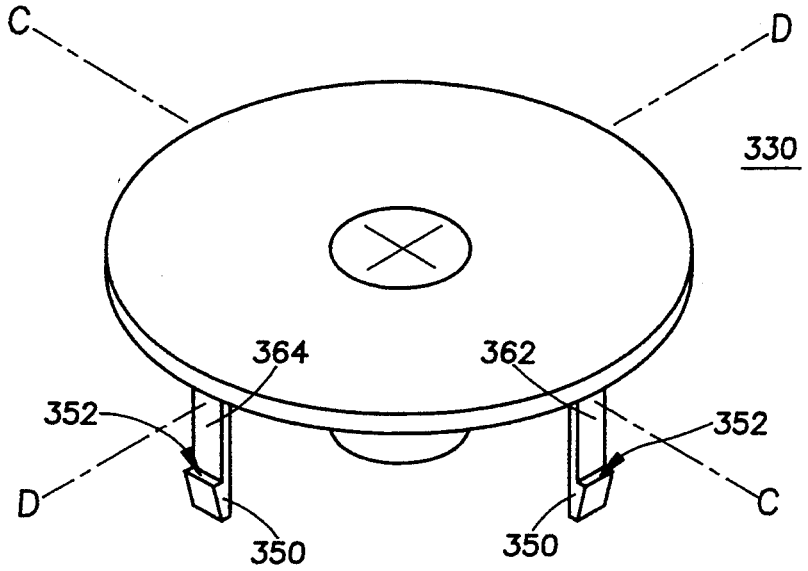
FIG. 8 is a perspective view of the second pivoting lock support.

The pivotable connection means 39 comprises a first pivoting lock support 320, a second pivoting lock support 330, and a washer 340. Lock supports 320 and 330 are best seen in FIGS. 7 and 8.

The first pivoting lock support 320 has a first circular disc-shaped base 322 with a protruding cylindrical male hemisphere connection member 324 extending downward from the center of the bottom surface of the first circular disc-shaped base 322. A first pair of diametrically opposed upper locking struts (340 and 342) are fixedly attached to the upper surface of the first circular disc-shaped base 322, the centerline A-A of the first pair of locking struts (340 and 342) being disposed in the X-Z plane defined by the vertical axis and the first horizontal axis. A second pair of diametrically opposed upper locking struts (344 and 346) are fixedly attached to the upper surface of the first circular disc-shaped base 322, the centerline B-B of the second pair of locking struts (344 and 346) being disposed in the Y-Z plane defined by the vertical axis and the second horizontal axis. A locking tooth 350 is disposed at the upper tip of each of the upper locking struts (340, 342, 344, and 346), each of the locking teeth 350 having a base 352 extending radially outward from the exterior surface of one of the upper locking struts. Each locking tooth 350 is provided for insertion into one of the first or second pair of diametrically opposed locking recesses of the first hollow hemispherical base member 36.

The second pivoting lock support 330 has a second circular disc-shaped base 332 and a cylindrical female hemispherical connection cavity 334 extending downward from the center of the bottom surface of the second circular disc-shaped base 332. The cavity 334 has an inner diameter substantially greater than the outer diameter of the protruding cylindrical male hemisphere connection member 324. The cavity 334 is sized for receiving the protruding cylindrical male hemisphere connection member 324.

The second pivoting lock support 330 also has a first pair of diametrically opposed lower locking struts (360 and 362) fixedly attached to the lower surface of the second circular disc-shaped base 332, the centerline C-C of the first pair of lower locking struts (360 and 362) being disposed in the X-Z plane defined by the vertical axis Z and the first horizontal axis X.

Additionally, the second pivoting lock support 330 is provided with a second pair of diametrically opposed lower locking struts (364 and 366) fixedly attached to the lower surface of the second circular disc-shaped base 332, the centerline D-D of the second pair of locking struts (364 and 366) being disposed in the Y-Z plane defined by the vertical axis Z and the second horizontal axis Y.

A locking tooth 350 is disposed at the lower tip of each of the lower locking struts (360, 362, 364 and 366), each of the locking teeth 350 having a base 352 extending radially outward from the exterior surface of one of the lower locking struts. Each locking tooth 350 is provided for insertion into one of the first or second pair of diametrically opposed locking recesses of the second hollow hemispherical base member 38.

The first pivoting lock support 320 and the second pivoting lock support 330 are shown in FIG. 3 as held together by washer 340. The protruding cylindrical male hemisphere connection member 324 of the first pivoting lock support 320 is inserted into the cylindrical female hemispherical connection cavity 334 of the second pivoting lock support 330 so that the bottom surface of the first circular disc-shaped base abuts, or is in close proximity to, the upper surface of the second circular disc-shaped base. The washer 340 is then slid over the protruding cylindrical male hemisphere connection member 324 and is locked in place by the pressure fit created by the inner diameter of the washer being substantially equal to the outer diameter of the protruding cylindrical male hemisphere connection member. The washer 340 thus substantially prevents the disengagement of the protruding cylindrical male hemisphere connection member 324 from the cylindrical female hemisphere connection cavity 334, yet allows the male connection member to freely and rotatably pivot within the cavity.

Figure 9:
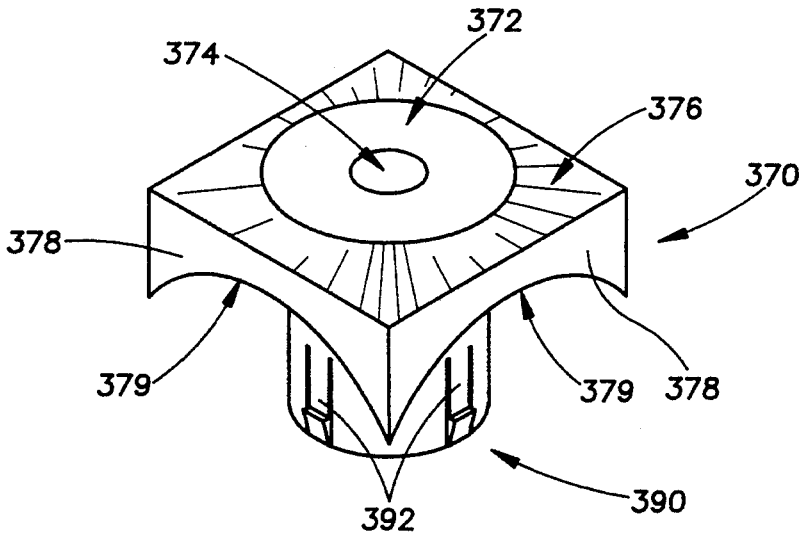
FIG. 9 is a perspective view of a cap.

As best seen in FIG. 9, caps (64 and 164) for locking insertion into cap-receiving channels (62 and 162, respectively) are identical in structure. Each cap (64 or 164) comprises a substantially quadrangular head section 370 and a hollow central cylindrical tail section 390. The head section 370 preferably has a substantially flat top surface portion 372, a top surface opening 374 disposed within the center of the substantially flat top surface portion 372, a tapered outer surface portion 376 surrounding the substantially flat top surface portion 372 and extending outwardly and downwardly therefrom, and four vertical endwalls 378 extending downward from the tapered outer surface portion 376, each of the endwalls 378 having an arcuate lower periphery 379.

The hollow central cylindrical tail section 390 preferably has a first pair of diametrically opposed locking tabs 392 disposed at the bottom of the hollow central cylindrical tail section 390 and a second pair of diametrically opposed locking tabs 392 disposed at the bottom of the hollow central cylindrical tail section, and located at right angles to the first pair of locking tabs.

As seen in FIGS. 4 and 6, the track means 32 comprises a first pair of substantially circular channels (400 and 402), the channels being concentric with the first horizontal axis X. The first pair of channels (400 and 402) are formed by the exterior surfaces of the hollow hemispherical inverted bowl member 60, the hemispherical bowl member 160, the cap 64 lockably inserted into the inverted bowl member 60, the cap 164 lockably inserted into the hemispherical bowl member 160, the first pair of diametrically opposed cylindrical supports (40 and 42) and the first pair of diametrically opposed spherical-segment portions (50 and 52).

The track means 32 also comprises a second pair of substantially circular channels (404 and 406) being concentric with the second horizontal axis Y. The second pair of channels are formed by the exterior surfaces of the hollow hemispherical inverted bowl member 60, the hemispherical bowl member 160, the cap 64 lockably inserted into the inverted bowl member 60, the cap 164 lockably inserted into the hemispherical bowl member 160, the second pair of diametrically opposed cylindrical supports (44 and 46) and the second pair of diametrically opposed spherical-segment portions (54 and 56).

The plurality of sliding truncated trapezoidal covers 34 comprises eight sliding truncated trapezoidal covers 34. Each trapezoidal cover 34 has: a (regular) triangular lower base 420 having a flat surface which forms an outer face 22; three inwardly inclined vertical walls (422, 424, and 426); a substantially circular upper base 428 having an upwardly concave surface 430, and a guide 432 disposed in the center of the upwardly concave surface 430 and upwardly extending therefrom. Each guide 432 has the shape of an inverted truncated cone; the cone may be hollow or solid.

Each guide 432 fits into a channel (400, 402, 404, or 406) of the track means 32 for providing the sliding engagement of the guide within the channel. Consequently, the guide 432 provides for the sliding engagement of the sliding truncated trapezoidal covers 34 over the surface of the hollow spherical base member 30.

The triangular lower base 420 of the trapezoidal cover 34 faces radially outwardly from the hollow spherical base member 30 when mounted in the track means 32, thusforming the outer faces 22 of the octahedron 20.

The plurality of tetrahedral members 30 comprises eight tetrahedrons 30. Each tetrahedron 30 has: a triangular base 440 with a periphery substantially similar to the triangular lower base of the truncated trapezoidal covers; and a tetrahedral connection means, preferably pivot pin 450 lockably inserted into pivot pin port 460 disposed in an outer face 22, on the outer surface of the triangular base 440, for connecting the tetrahedron to the triangular lower base of one of the truncated trapezoidal covers.

The elements of the present invention can be preferably made of injection molded plastic. Washer 340 may preferably be made from metal.

A preferred method of assembly would include:

(a) inserting the protruding cylindrical male hemisphere connection member 324 into the cylindrical female hemisphere connection cavity 334 so that the male hemisphere connection member 324 passes through and extends beyond the edge of the cavity 334;

(b) forcing the washer 340 over the protruding cylindrical male hemisphere connection member 324; placing caps 64 and 164 into the cap-receiving channels 62 and 162, respectively;

(c) rotatably sliding the guides 432 of two truncated trapezoidal covers 34 into one of the first pair of semicircular channels (corresponding to channels 400 or 402) formed by the exterior surfaces of the hollow hemispherical inverted bowl member 60, the cap 64, the first pair of demi-cylindrical supports (70 and 72) and the first pair of spherical-segment demi-portions (80 and 82) of the first hollow hemispherical base member 36;

(d) rotatably sliding the guides 432 of another two truncated trapezoidal covers 34 into a second one of the first pair of semicircular channels (corresponding to channels 402 or 400, respectively) formed by the exterior surfaces of the hollow hemispherical inverted bowl member 60, the cap 64, the first pair of demi-cylindrical supports (70 and 72) and the first pair of spherical-segment demi-portions (80 and 82);

(e) rotatably sliding the 432 guides of still another two truncated trapezoidal covers 34 into one of the first pair of semicircular channels (corresponding to channels 400 or 402) formed by the exterior surfaces of the hollow hemispherical bowl member 160, the cap 164, the first pair of demi-cylindrical supports (170 and 172) and the first pair of spherical-segment demi-portions (180 and 182) of the second hollow hemispherical base member 38;

(f) rotatably sliding the guides 432 of the last two truncated trapezoidal covers 34 into a second one of the first pair of semicircular channels (corresponding to channels 402 or 400, respectively) formed by the exterior surfaces of the hollow hemispherical inverted bowl member 160, the cap 164, the first pair of demi-cylindrical supports (170 and 172) and the first pair of spherical-segment demi-portions (180 and 182);

(g) snapping the first pivoting lock support 320 into the first hollow hemispherical base member 36 by inserting the plurality of locking teeth 350 into the locking recesses (300, 302, etc.) of the first hollow hemispherical base member 36;

(h) snapping the second pivoting lock support 330 (and the previously attached first pivoting lock support 320 and first hollow hemispherical base member 36) into the second hollow hemispherical base member 38 by inserting the plurality of locking teeth 350 into the locking recesses (310, 312, etc.) of the second hollow hemispherical base member 38;

(i) connecting a tetrahedral member 30 to each one of the eight outer faces 22 of the resulting octahedron 20 such that the tetrahedral member 30 is able to rotatably pivot atop the face 22.

The various surfaces of the tetrahedral members 30 are preferably of various colors. The coloring may be achieved by paints, dyes, decals, variously colored plastics used during the injection process, or any other suitable means for achieving various color schemes on the outer surfaces of the puzzle 10.

Thus assembled, the surfaces of the puzzle 10 can be manipulated by a user into many different configurations. Any four tetrahedrons 30 can be rotated with respect to the remaining four tetrahedrons 30 about one of three orthogonal axes (X, Y, and Z). The top half of the invention 10 can be rotated either clockwise or counterclockwise about the Z axis, relative to the bottom of the invention, by grasping the bottom portion and rotating the top portion. Likewise the bottom portion can be similarly rotated. Alternatively, any four of the tetrahedrons 30 which face a lateral plane can be grasped and rotated about a horizontal axis (X or Y) with respect to the remaining four tetrahedrons facing the other side. Moreover, each tetrahedron 30 can be rotated about its own pivot axis.

Therefore, various color patterns may be achieved with various arrangements of the outer surfaces of the tetrahedrons 30. One goal of the user may be to achieve a particular overall color pattern by matching like-colored surfaces to like-spatially-situated locations or planes.

A variation of the invention would be to include one or more lights mounted in, or on, or under, one or more of the twenty four faces of the eight tetrahedrons 30. The lights could be lit according to specific rules, telling the player about his performance, or telling the player about objectives to be achieved. Of course, the lights could be colored, and they may blink or stay lit.

Another variation would be to include the production of one or more sounds as moves on the invention are completed.

What is claimed is:

1. A three-dimensional puzzle, rotatable about three orthogonal axes, the three orthogonal axes consisting of a vertical axis, a first horizontal axis, and a second horizontal axis, the three-dimensional puzzle comprising:

(a) a hollow spherical base member comprising:

a first hemispherical base member;

a second hemispherical base member; and a pivotable connection means for connecting said first hemispherical base member to said second hemispherical base member and for allowing said first hemispherical base member and said second hemispherical base member to rotate in a plane defined by the first horizontal axis and the second horizontal axis;

(b) a track means formed by an outer surface of said spherical base member;

(c) a plurality of sliding truncated trapezoidal covers slidably mounted in said track means, each of said trapezoidal covers having a radially outward surface which forms one of the eight faces of said octahedral base member; and (d) a plurality of tetrahedral members, one tetrahedral member pivotally mounted on the radially outward surface of each of said sliding truncated trapezoidal covers.

2. A three-dimensional puzzle, according to claim 1, wherein said hollow spherical base member further comprises:

(a) a first pair of diametrically opposed cylindrical supports fixedly attached to an outer surface of said hollow spherical base member and extending radially outward therefrom along the first horizontal axis;

(b) a first pair of diametrically opposed spherical-segment portions, one of said first pair of spherical-segment portions positioned on a radially outwardmost surface of one of said first pair of diametrically opposed cylindrical supports, and the other of said first pair of spherical-segment portions positioned on a radially outwardmost surface of the other one of said first pair of diametrically opposed cylindrical supports, said first pair of diametrically opposed spherical-segment portions being concentric with said first horizontal axis;

(c) a second pair of diametrically opposed cylindrical supports fixedly attached to an outer surface of said hollow spherical base member and extending radially outward therefrom along the second horizontal axis; and (d) a second pair of diametrically opposed spherical-segment portions, one of said second pair of spherical-segment portions positioned on a radially outwardmost surface of one of said second pair of diametrically opposed cylindrical supports, and the other of said second pair of spherical-segment portions positioned on the other one of said second pair of diametrically opposed cylindrical supports, said second pair of diametrically opposed spherical-segment portions being concentric with said second horizontal axis.

3. A three-dimensional puzzle, according to claim 2, wherein said track means comprises at least one channel formed from an exterior surface of: said first hemispherical base member, said second hemispherical base member, said first pair of diametrically opposed cylindrical supports, said second pair of diametrically opposed cylindrical supports, said first pair of diametrically opposed spherical-segment portions, and said second pair of diametrically opposed spherical-segment portions.

4. A three-dimensional puzzle, according to claim 3, wherein said first hollow hemispherical base member comprises:

(a) a hollow hemispherical inverted bowl member;

(b) a cap-receiving channel disposed at a top of said hollow hemispherical inverted bowl member and being concentric with the vertical axis;

(c) a cap for locking insertion into said cap receiving channel;

(d) a first pair of diametrically opposed demi-cylindrical supports fixedly attached to an exterior surface of said hollow hemispherical inverted bowl member and extending radially outward therefrom, each of said first pair of demi-cylindrical supports having both a substantially flat lower surface and a longitudinal axis coincident with the first horizontal axis;

(e) a first pair of diametrically opposed spherical-segment demi-portions, each of said demi-portions having:

a flat bottom surface;

an outwardly radial surface having a contour of a spherical segment; and a flat inner surface fixedly attached to an outwardmost radially extending surface of one of said first pair of diametrically opposed demi-cylindrical supports;

(f) a second pair of diametrically opposed demi-cylindrical supports fixedly attached to the exterior surface of said hollow hemispherical inverted bowl member and extending radially outward therefrom, each of said second pair of demi-cylindrical supports having both a substantially flat lower surface and a longitudinal axis coincident with the second horizontal axis; and (g) a second pair of diametrically opposed spherical-segment demi-portions, each of said demi-portions having:

a flat bottom surface;

an outwardly radial surface having a contour of a spherical segment; and a flat inner surface fixedly attached to an outwardmost radially extending surface of one of said second pair of diametrically opposed demi-cylindrical supports.

5. A three-dimensional puzzle, according to claim 4, wherein said second hollow hemispherical base member comprises:

(a) a hollow hemispherical bowl member;

(b) a cap-receiving channel disposed at a bottom of said hollow hemispherical bowl member and being concentric with the vertical axis;

(c) a cap for locking insertion into said cap-receiving channel;

(d) a first pair of diametrically opposed demi-cylindrical supports fixedly attached to an exterior surface of said hollow hemispherical bowl member and extending radially outward therefrom, each of said first pair of demi-cylindrical supports having both a substantially flat upper surface and a longitudinal axis coincident with the first horizontal axis;

(e) a first pair of diametrically opposed spherical-segment demi-portions, each of said demi-portions having:

a flat upper surface;

an outwardly radial surface having a contour of a spherical segment; and a flat inner surface fixedly attached to an outwardmost radially extending surface of one of said first pair of diametrically opposed demi-cylindrical supports;

(f) a second pair of diametrically opposed demi-cylindrical supports fixedly attached to the exterior surface of said hollow hemispherical bowl member and extending radially outward therefrom, each of said second pair of demi-cylindrical supports having both a substantially flat upper surface and a longitudinal axis coincident with the second horizontal axis; and (g) a second pair of diametrically opposed spherical-segment demi-portions, each of said demi-portions having:

a flat upper surface;

an outwardly radial surface having a contour of a spherical segment; and a flat inner surface fixedly attached to an outwardmost radially extending surface of one of said second pair of diametrically opposed demi-cylindrical supports;

wherein said first hollow hemispherical base member and said second hollow hemispherical base member are connected together so as to form said hollow spherical base member;

whereby said first pair of diametrically opposed spherical-segment demi-portions of said first hollow hemispherical base member and said first pair of diametrically opposed spherical-segment demi-portions of said second hollow hemispherical base member mate to form said first pair of diametrically opposed spherical-segment portions;

whereby said second pair of diametrically opposed spherical-segment demi-portions of said first hollow hemispherical base member and said second pair of diametrically opposed spherical-segment demi-portions of said second hollow hemispherical base member mate to form said second pair of diametrically opposed spherical-segment portions;

whereby said first pair of diametrically opposed demi-cylindrical supports of said first hollow hemispherical base member and said first pair of diametrically opposed demi-cylindrical supports of said second hollow hemispherical base member mate to form said first pair of diametrically opposed cylindrical supports; and whereby said second pair of diametrically opposed demi-cylindrical supports of said first hollow hemispherical base member and said second pair of diametrically opposed demi-cylindrical supports of said second hollow hemispherical base member mate to form said second pair of diametrically opposed cylindrical supports.

6. A three-dimensional puzzle, according to claim 5, wherein:

(a) said first hollow hemispherical base member further comprises:

a first pair of diametrically opposed locking recesses provided on an interior surface of said hollow hemispherical inverted bowl member in a plane defined by the vertical axis and the first horizontal axis;

a second pair of diametrically opposed locking recesses provided on the interior surface of said hollow hemispherical inverted bowl member in a plane defined by the vertical axis and the second horizontal axis; and (b) said second hollow hemispherical base member further comprises:

a first pair of diametrically opposed locking recesses provided on an interior surface of said hollow hemispherical bowl member in a plane defined by the vertical axis and the first horizontal axis;

a second pair of diametrically opposed locking recesses provided on the interior surface of said hollow hemispherical bowl member in a plane defined by the vertical axis and the second horizontal axis.

7. A three-dimensional puzzle, according to claim 6, wherein said pivotable connection means comprises:

(a) a first pivoting lock support having:

a first circular disc-shaped base;

a protruding cylindrical male hemisphere connection member extending downward from a center of a bottom surface of said first circular disc-shaped base;

a first pair of diametrically opposed upper locking struts fixedly attached to an upper surface of said first circular disc-shaped base, a centerline of said first pair of locking struts being disposed in the plane defined by the vertical axis and the first horizontal axis;

a second pair of diametrically opposed upper locking struts fixedly attached to an upper surface of said first circular disc-shaped base, a centerline of said second pair of locking struts being disposed in the plane defined by the vertical axis and the second horizontal axis;

a plurality of locking teeth, one of said plurality of locking teeth being disposed at an upper tip of each of said upper locking struts, each of said locking teeth having:

a base extending radially outward from an exterior surface of one of said upper locking struts; and said locking tooth being provided for insertion into one of said first pair of diametrically opposed locking recesses of said first hollow hemispherical base member;

(b) a second pivoting lock support having:

a second circular disc-shaped base;

a cylindrical female hemispherical connection cavity extending downward from a center of a bottom surface of said second circular disc-shaped base, said cavity having an inner diameter substantially greater than the outer diameter of said protruding cylindrical male hemisphere connection member, said cavity for receiving said protruding cylindrical male hemisphere connection member;

a first pair of diametrically opposed lower locking struts fixedly attached to a lower surface of said second circular disc-shaped base, a centerline of said first pair of lower locking struts being disposed in the plane defined by the vertical axis and the first horizontal axis;

a second pair of diametrically opposed lower locking struts fixedly attached to a lower surface of said second circular disc-shaped base, a centerline of said second pair of lower locking struts being disposed in the plane defined by the vertical axis and the second horizontal axis;

a plurality of locking teeth, one of said plurality of locking teeth being disposed at a lower tip of each of said lower locking struts, each of said locking teeth having:

a base extending radially outward from an exterior surface of one of said lower locking struts; and said locking tooth being provided for insertion into one of said second pair of diametrically opposed locking recesses of said second hollow hemispherical base member; and (c) a washer having an inner diameter substantially equal to an outer diameter of said protruding cylindrical male hemisphere connection member;

whereby said washer fits over said protruding cylindrical male hemisphere connection member and remains locked in place by pressure-fit; and whereby said protruding cylindrical male hemisphere connection member rotatably pivots within said cylindrical female hemisphere connection cavity, thereby providing a pivot for the relative rotation between said first hemispherical base member and said second hemispherical member around the vertical axis.

8. A three-dimensional puzzle, according to claim 7, wherein said cap comprises:

(a) a substantially quadrangular head section comprising:

a substantially flat top surface portion;

a top surface opening disposed within a center of said substantially flat top surface portion;

a tapered outer surface portion surrounding said substantially flat top surface portion and extending outwardly and downwardly therefrom; and four vertical endwalls extending downward from said tapered outer surface portion, each of said endwalls having an arcuate lower periphery; and (b) a hollow central cylindrical tail section having:

a first pair of diametrically opposed locking tabs disposed at a bottom of said hollow central cylindrical tail section; and a second pair of diametrically opposed locking tabs disposed at the bottom of said hollow central cylindrical tail section.

9. A three-dimensional puzzle, according to claim 8, wherein said at least one channel of said track means further comprises:

(a) a first pair of substantially circular channels being concentric with the first horizontal axis and being formed by the exterior surfaces of said hollow hemispherical inverted bowl member, said hemispherical bowl member, said cap lockably inserted into said inverted bowl member, said cap lockably inserted into said hemispherical bowl member, said first pair of diametrically opposed cylindrical supports and said first pair of diametrically opposed spherical-segment portions; and (b) a second pair of substantially circular channels being concentric with the second horizontal axis and being formed by the exterior surfaces of said hollow hemispherical inverted bowl member, said hemispherical bowl member, said cap lockably inserted into said inverted bowl member, said cap lockably inserted into said hemispherical bowl member, said second pair of diametrically opposed cylindrical supports and said second pair of diametrically opposed spherical-segment portions.

10. A three-dimensional puzzle, according to claim 9, wherein said plurality of sliding truncated trapezoidal covers comprises eight sliding truncated trapezoidal covers having:

a triangular lower base having a flat surface;

three inwardly inclined vertical walls; and a substantially circular upper base having:

an upwardly concave surface; and a guide disposed in a center of said upwardly concave surface and upwardly extending therefrom, said guide having:

an inverted truncated conical outer wall;

whereby said guide fits into said at least one channel of said track means for providing the sliding engagement of said guide within said at least one channel, and for providing the sliding engagement of said sliding truncated trapezoidal covers over the surface of said hollow spherical base member; and whereby said triangular lower base faces radially outwardly from said hollow spherical base member;

11. A three-dimensional puzzle, according to claim 10, wherein said plurality of tetrahedral members comprises eight tetrahedrons, each tetrahedron having:

(a) a triangular base with a periphery substantially similar to the triangular lower base of said truncated trapezoidal covers; and (b) a tetrahedral connection means disposed on an outer surface of said triangular base for connecting said tetrahedron to the triangular lower base of one of said truncated trapezoidal covers.

* * * * *